US010363760B2

(12) United States Patent
Van Herpen et al.

(10) Patent No.: US 10,363,760 B2
(45) Date of Patent: Jul. 30, 2019

(54) DUPLEX PRINTING SYSTEM FOR CUT SHEETS AND A METHOD THEREFOR

(71) Applicant: Océ Holding B.V., Venlo (NL)

(72) Inventors: Wilhelmus M. Van Herpen, Venlo (NL); Patrick G. H. Vestjens, Venlo (NL); Ronnie J. H. G. Berghs, Venlo (NL); Marcel J. H. M. Haenen, Venlo (NL); Jacobus J. Kandelaars, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/043,622

(22) Filed: Jul. 24, 2018

(65) Prior Publication Data

US 2018/0326762 A1 Nov. 15, 2018

Related U.S. Application Data

(63) Continuation of application No. PCT/EP2017/051179, filed on Jan. 20, 2017.

(30) Foreign Application Priority Data

Feb. 1, 2016 (EP) ..... 16153700

(51) Int. Cl.
*B41J 13/00* (2006.01)
*B41J 3/60* (2006.01)
(Continued)

(52) U.S. Cl.
CPC ..... *B41J 13/009* (2013.01); *B41J 3/60* (2013.01); *B41J 11/002* (2013.01);
(Continued)

(58) Field of Classification Search
CPC .... B41J 13/009; B41J 13/0009; B41J 11/002; B41J 3/60; G03G 15/6564; G03G 15/234; G03G 13/23; G03G 15/5083
See application file for complete search history.

(56) References Cited

U.S. PATENT DOCUMENTS

2004/0091295 A1 5/2004 Nakamura et al.
2012/0075395 A1 3/2012 Moore
(Continued)

OTHER PUBLICATIONS

International Search Report (PCT/ISA/210) issued in PCT/EP2017/051179, dated Mar. 21, 2017.
(Continued)

*Primary Examiner* — Kristal Feggins
(74) *Attorney, Agent, or Firm* — Birch, Stewart, Kolasch & Birch, LLP

(57) ABSTRACT

A printing system for cut sheets includes a controller configured to control the printing of image data on a plurality of sheets and scheduling the plurality of sheets in a printing order, a paper path comprising a duplex printing loop and a rotational functional component arranged in the duplex printing loop for guiding and processing a printed sheet for two passes along or on a surface of the rotational functional component, a print engine arranged in the duplex printing loop and configured to dispose marking material on the sheets according to the image data, in two passes, one side per pass. The controller is configured to schedule one-sided printed sheets for a first pass guided along or on the surface of the rotational functional component and two-sided printed sheets for a second pass guided along or on the surface of the rotational functional component by using the duplex printing loop and to determine a distance between subsequent sheets guided along or on the surface of the rotational functional component such that a location on the surface of the rotational functional component is covered by printed
(Continued)

sides of two-sided sheets at most a maximum number of times before the location on the surface of the rotational functional component is covered by an unprinted side of a sheet. The maximum number is determined by a degree of pollution caused by the marking material printed on two-sided printed sheets when taking a second pass along or on the surface of the rotational functional component.

16 Claims, 4 Drawing Sheets

(51) Int. Cl.
*B41J 11/00* (2006.01)
*G03G 13/23* (2006.01)
*G03G 15/23* (2006.01)
*G03G 15/00* (2006.01)

(52) U.S. Cl.
CPC ..... *B41J 13/0009* (2013.01); *G03G 13/23* (2013.01); *G03G 15/234* (2013.01); *G03G 15/6564* (2013.01); *G03G 15/5083* (2013.01)

(56) References Cited

U.S. PATENT DOCUMENTS

2014/0029991 A1 1/2014 Kubota
2014/0071194 A1* 3/2014 Inokuchi ..... B41J 11/70 347/16
2014/0210895 A1* 7/2014 Sosnowski ..... B41J 13/0009 347/16
2014/0240381 A1* 8/2014 Fujimoto ..... B41J 3/60 347/5
2015/0266315 A1* 9/2015 Mallinson ..... B41J 3/60 347/104

OTHER PUBLICATIONS

Written Opinion (PCT/ISA/237) issued in PCT/EP2017/051179, dated Mar. 21, 2017.

* cited by examiner

DUPLEX PRINTING SYSTEM FOR CUT SHEETS AND A METHOD THEREFOR

CROSS REFERENCE TO RELATED APPLICATIONS

This application is a Continuation of PCT International Application No. PCT/EP2017/051179, filed on Jan. 20, 2017, which claims priority under 35 U.S.C. 119(a) to Patent Application No. 16153700.6, filed in the Europe on Feb. 1, 2016, all of which are hereby expressly incorporated by reference into the present application.

The present invention relates to a printing system for cut sheets, the printing system comprising a control unit for controlling the printing of image data on a plurality of sheets and scheduling the plurality of sheets in a printing order, a paper path comprising a duplex printing loop and a rotational functional component arranged in the duplex printing loop for guiding and processing a printed sheet for two passes along or on a surface of the rotational functional component, a print engine arranged in the duplex printing loop and configured to dispose marking material on the sheets according to the image data, in two passes, one side per pass.

According to the paper path of a printing system each of the plurality of sheets is transported from an input section of the printing system towards a print head or print assembly. By means of the print head or print assembly marking material is disposed on each of the plurality of sheets. Each of the plurality of sheets is guided from the print head or print assembly towards a surface of a rotational functional component like a fixation drum for fixing the marking material to the sheets. The marking material may be ink which has to be dried or a toner which has to be fused to the sheets. To enable duplex printing the paper path contains a loop, a so-called duplex loop. A sheet enters the loop in a first pass in order to print image data on one side of the sheet, goes through the duplex loop and enters the duplex loop in a second pass in order to print image data on the other side of the sheet. After a sheet has been printed upon on both sides, the sheet is transported to the output section for further finishing. A print engine with a loop may have a print speed of twice as high as a speed of a separation in the input module and a working speed of an output module or finisher. In such a case the loop may be used to print on the plurality of sheets by interweaving the plurality of sheets in the first pass and in the second pass.

A problem arises when two-sided printed sheets are guided on or along the rotational functional component. The rotational functional component has at least one rotational axis, for example a drum, an endless belt, an endless surface, etc. Since one of the two sides which has been printed upon with marking material is contacting the outer surface of the rotational functional component, the outer surface is polluted. Hereinafter the outer surface of the rotational functional component will be called surface or circumference.

Prior art of a cleaning device is known to clean the surface of the functional component. The cleaning device is an additional device comprised in the printing system leading to a higher cost price of the printing system. Additional maintenance actions on the cleaning device and additional cleaning actions by means of the cleaning device also lead to a lower productivity caused by a stop of the printing system during cleaning.

It is an objective of the invention to provide a printing system that permits to clean the surface of the rotational functional component without the use of any cleaning device or additionally to a cleaning device.

In order to achieve this objective, according to the invention, the control unit is configured to schedule one-sided printed sheets for a first pass guided along or on the surface of the rotational functional component and two-sided printed sheets for a second pass guided along or on the surface of the rotational functional component by using the duplex printing loop and to determine a distance between subsequent sheets guided along or on the surface of the rotational functional component such that a location on the surface of the rotational functional component is covered by printed sides of two-sided printed sheets at most a maximum number of times before the location on the surface of the rotational functional component is covered by an unprinted side of a one-sided printed sheet. The maximum number is determined by a degree of pollution caused by the marking material printed on two-sided printed sheets when taking a second pass along or on the surface of the rotational functional component. The degree of pollution is established by experiments of printing marking material on sheets and determining how much contamination is left on the rotational functional component. Such an experiment may be executed before and/or during installation of the printing system or during the lifetime of the printing system at appropriate time intervals.

The unprinted side of each one sided printed sheet which is guided along the surface of the rotational functional component contacts the surface of the rotational functional component and takes away marking material from the surface of the rotational functional component and/or diminishes the accumulation of marking material on the surface of the rotational functional component. By scheduling the sheets such that an unprinted side of a sheet is covering the surface of the rotational functional component after an at most maximum number of times a particular location on the surface of the rotational functional component is touched by a printed side of a sheet, the whole surface is cleaned before pollution by marking material becomes a problem. The inter sheet distance may be increased to ensure that two-sided printed sheets during the second pass do not overlap or partially overlap in subsequent revolutions of the rotational functional component.

By using the sheets that are being printed, no additional hardware is necessary and printing can continue while cleaning the rotational functional component. By using a dedicated inter sheet distance based on a maximum number of coverings of each location of the surface a balance can be found between polluting and cleaning.

According to an embodiment of the printing system, the control unit is configured to schedule alternately sheets for the first pass and sheets for the second pass guided along or on the surface of the rotational functional component. This embodiment gives a large freedom of choosing the inter sheet distance while the productivity keeps on track.

The invention is applicable to rotational functional components which have a surface length of arbitrary length, i.e. a circumference length of the rotational functional component, or even a length other than a natural number of sheet lengths, just by counting the number of coverings by printed sides of sheet along the surface of the rotational functional component to the determined maximum number of times. Scheduling, i.e. determination of the inter sheet distance according to the invention, is possible since the length of the surface of the functional component and the sheet velocity in the paper path are known by design of the printing system.

According to a particular embodiment the maximum number of times is corresponding to a number of revolutions of the rotational functional component taking into account the degree of pollution. The number of revolutions of the rotational functional component may be equal to a natural number n greater or equal to two, leading to a location on the rotational functional component being covered by an unprinted sheet each n-th revolution of the rotational functional component. The number of revolutions of the rotational functional component may be maximized while taking into account the degree of pollution. Actually this is quite a specific embodiment when the length of the surface of the rotational component is approximately a natural number of sheet lengths.

According to an embodiment the rotational functional component is a fixation drum or fixation belt for fixing the marking material to the sheets. When the marking material is a toner substance, the rotational functional component may be a fuser for fusing the toner substance on the sheets. When the marking material is an ink substance, the rotational functional component is a drying device for drying the ink substance on the sheets. The rotational functional component may be another rotational functional component than a fixation drum, for example an endless belt, and endless surface, etc. In fact, the invention is applicable to each rotational functional component in the duplex loop of the paper path of the printing system that suffers from polluting by already two-sided printed sheets which can be prevented by one-sided printed sheets.

According to an embodiment the maximum number of times is determined per media type of the sheets to be printed and/or per type of marking material to be used for printing on the sheets. Different media types and different marking material types may lead to different degrees of pollution.

Properties of the media types used by the printing system are usually stored in a so-called digital media catalogue in storage residing in the printing system. According to an embodiment a property of a media type in the media catalogue is a value for the maximum number of coverings of a location of the surface of the rotational functional component by printed sides of sheets also known as the maximum number of "stamps". Establishment of the number of "stamps" for a media type may be executed when a new media type is going to be used in the printing system and is defined in the media catalogue of the printing system.

Properties of the marking material types used by the printing system are usually stored in a collection of stored system settings for the printing system. According to an embodiment a system setting of a marking material type is a value for the maximum number of coverings of a location of the surface of the rotational functional component by printed sides of sheets also known as the maximum number of "stamps".

Establishment of the number of "stamps" for a marking material type may be executed when a new marking material type is going to be used in the printing system and is defined as a system setting of the printing system.

The invention also relates to a method for time scheduling a plurality of sheets in a duplex printing loop of a printing system which comprises a control unit for controlling the printing of image data on the plurality of sheets and scheduling the plurality of sheets in a printing order, a paper path comprising the duplex printing loop in order to enable printing on both sides of the plurality of sheets in an interweaving first and second pass in the duplex printing loop, a print head or print assembly arranged in the duplex printing loop for disposing marking material on the sheets according to the image data, and a rotational functional component arranged in the duplex printing loop for guiding and processing printed sheets along or on a surface of the rotational functional component, wherein the method comprises the steps of scheduling sheets of the plurality for a first pass guided along or on the surface of the rotational functional component, scheduling sheets of the plurality for a second pass guided along or on the surface of the rotational functional component, determining a distance between subsequent sheets guided along or on the surface of the rotational functional component such that each location on the surface of the rotational functional component is covered by printed sides of two-sided sheets at most a maximum number of times before the location on the surface of the rotational functional component is covered by an unprinted side of a sheet, the maximum number of times being determined by a degree of pollution caused by the marking material printed on two-sided printed sheets when taking a second pass along or on the surface of the rotational functional component, and printing the scheduled sheets of the plurality by means of the duplex printing loop using the determined distance.

According to an embodiment the method comprises the step of scheduling alternately sheets for the first pass and sheets for the second pass guided along or on the surface of the rotational functional component.

According to an embodiment the maximum number of times is corresponding to a predetermined number of revolutions of the rotational functional component.

According to an embodiment the number of revolutions of the rotational functional component is equal to a natural number n greater or equal to two, leading to a location on the rotational functional component being covered by an unprinted sheet each n-th revolution of the rotational functional component.

According to an embodiment the number of revolutions of the rotational functional component is maximized while taking into account the degree of pollution.

According to an embodiment the method comprises the step of abutting a location covered by a one-sided printed sheet in a covering of the surface of the rotational functional component on to a location covered by a one-sided printed sheet in a next covering of the surface of the rotational functional component.

According to an embodiment the method comprises the step of partially overlapping a location covered by a one-sided printed sheet in a covering of the surface of the rotational functional component with a location covered by a one-sided printed sheet in a next covering of the surface of the rotational functional component, wherein the degree of partially overlapping depends on the degree of pollution.

According to an embodiment the maximum number of times is determined per media type of the sheets to be printed and/or per type of marking material to be used for printing on the sheets. It may be allowed to have more than one two-sided printed sheet on the same location on the surface of the rotational functional component before cleaning is started by using one-sided printed sheets. For instance, when it is allowed to have two two-sided printed sheets on the same location of the surface in subsequent revolutions of the rotational functional component before a one-sided printed sheet prevents built up of the pollution, an overlap of two-sided printed sheets on the same location of maximum 50% is allowed.

The invention also relates to a software product comprising program code on a computer-readable medium, wherein said program code, when loaded into a computer that is connected to a printing system according to the invention causes the computer to act according to a method of the invention.

Preferred embodiments will now be described in conjunction with the drawings, wherein.

Figure 1:
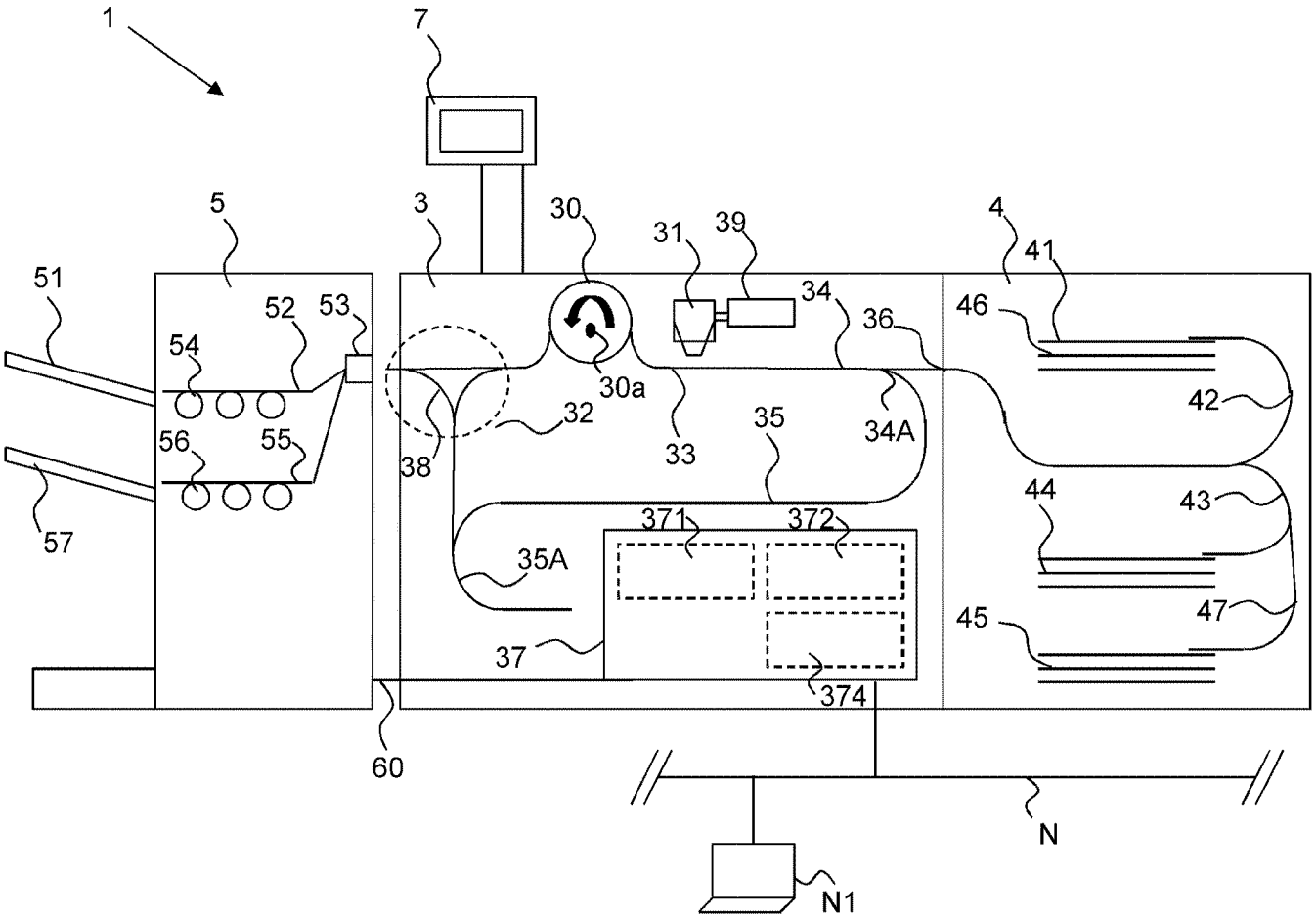
FIG. 1 is a schematic view of the printing system according to the invention.

FIG. 1 shows schematically an embodiment of a printing system 1 according to the invention. The printing system 1, for purposes of explanation, is divided into an output section 5, a print engine and control section 3, a local user interface 7 and an input section 4. While a specific printing system is shown and described, the disclosed embodiments may be used with other types of printing system such as ink jet, electrographic, etc.

The output section 5 comprises a first output holder 52 for holding printed image receiving material, for example a plurality of sheets. The output section 5 may comprise a second output holder 55. The printed image receiving material is transported from the print engine and control section 3 via an inlet 53 to the output section 5. When a stack ejection command is invoked by the control unit 37 for the first output holder 52, first guiding means 54 are activated in order to eject the plurality of sheets in the first output holder 52 outwards to a first external output holder 51. When a stack ejection command is invoked by the control unit 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a control unit 37 for controlling the printing process and scheduling the plurality of sheets in a printing order before they are separated from input holder 44, 45, 46.

The control unit 37 is a computer, a server or a workstation, connected to the print engine and connected to the digital environment of the printing system, for example a network N for transmitting a submitted print job to the printing system 1. In FIG. 1 the control unit 37 is positioned inside the print engine and control section 3, but the control unit 37 may also be at least partially positioned outside the print engine and control section 3 in connection with the network N in a workstation N1.

The control unit 37 comprises a print job receiving section 371 permitting a user to submit a print job to the printing system 1, the print job comprising image data to be printed and a plurality of print job settings. The control unit 37 comprises a print job queue section 372 comprising a print job queue for print jobs submitted to the printing system 1 and scheduled to be printed. The control unit 37 comprises a sheet scheduling section 374 for determining for each of the plurality of sheets of the print jobs in the print job queue an entrance time in the paper path of the print engine and control section 3, especially an entrance time for the first pass and an entrance time for the second pass in the duplex printing loop in the paper path according to the invention. By the determination of the entrance time of each sheet for the first pass and the second pass in the loop, the sheet scheduling section 374 also determines an inter sheet distance between subsequent sheets in the duplex printing loop. A loop time duration of a sheet going through the loop depends on the velocity of the sheets in the loop. The loop time duration may vary per kind of sheet, i.e. a sheet of a different media type.

Resources may be sheets of media type material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the invention. The loop enables the printing of a duplex print job and/or a mix-plex job, i.e. a print job comprising a mix of sheets intended to be printed partially in a simplex mode and partially in a duplex mode.

The print head or print assembly 31 is suitable for disposing marking material to the sheets. The print head or print assembly 31 is positioned near the paper path section 34. The print head or print assembly 31 may be an inkjet print head, a direct imaging toner assembly or an indirect imaging toner assembly.

While a sheet is transported along the paper path section 34 in a first pass in the loop, the sheet receives the marking material through the print head or print assembly 31. Directly downstream of the print head or print assembly 31 a rotational functional component 30 is situated, for example, a fixation drum, a fixation belt, a fixation device, a drying device, a drying drum , a drying belt, a fusing device, a fusing belt, a fusing drum, etc. The rotational functional component 30 may have a cylindrically shaped surface or any other rotatable surface around an axis 30*a* perpendicular to the drawing of FIG. 1. The surface may be an endless surface. The circumference is circular, ellipsoidal, belt-shaped. The rotational functional component has at least one rotational axis. The surface is configured to fix the marking material to the sheet or to dry the marking material on the sheet. The sheet is taken up at the right side of the rotational functional component 30 and turned to the left side of the rotational functional component 30. A next paper path section 32 is a flip unit 32 for selecting a different subsequent paper path for simplex or duplex printing of the image receiving material. The flip unit 32 may be also used to flip a sheet after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop. The sheets coming from the paper path section 35 are starting their second pass along the print head or print assembly 31 in the loop. When a sheet has passed the print head or print assembly 31 for the second time in the second pass, the sheet is guided along the rotational functional component 30 and is further transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties.

The local user interface 7 is suitable for displaying user interface windows for controlling the print job queue residing in the control unit 37. In another embodiment a computer N1 in the network N has a user interface for displaying and controlling the print job queue of the printing system 1.

Figure 2:
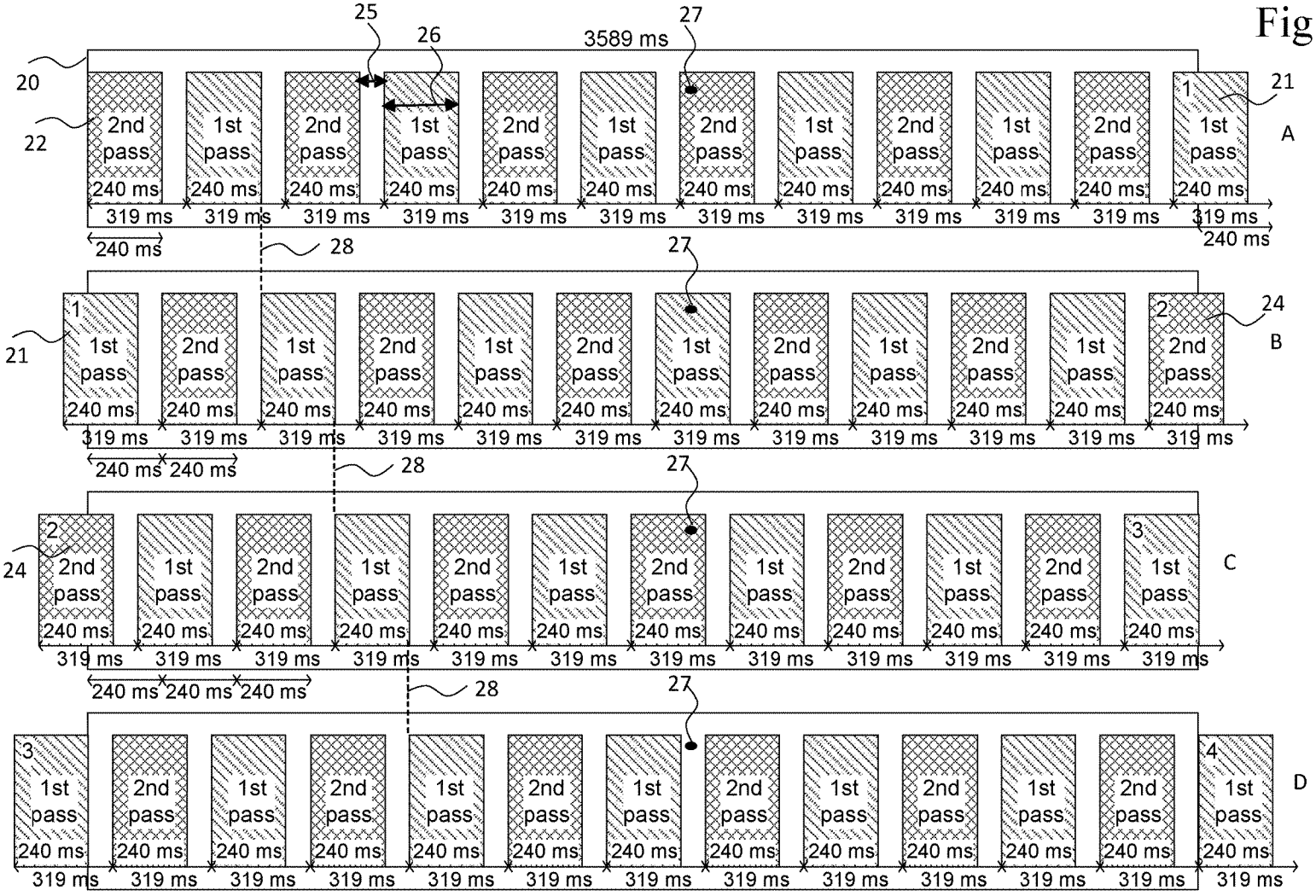
FIG. 2 is a first schematic view of scheduled sheets on the surface of the rotational functional component of the printing system according to the invention.

FIG. 2 is a first schematic view of scheduled sheets on the surface of the rotational functional component of the printing system according to the invention. For convenience reasons a velocity of the sheets in the duplex loop of the printing system is selected to be approximately 1.25 m per second. A default sheet distance between subsequent sheets in the duplex loop and thus also on the rotational functional component is corresponding to 60 msec (milliseconds). According to this embodiment the length of the surface is corresponding to 3589 msec. Other lengths of the surface may be envisioned. The sheet length 26 corresponds to 240 msec while the space occupied by each sheet corresponds to 319 msec leaving 79 msec corresponding to the inter sheet distance 25. The sheets are A4 sized. Other sheet sizes may be envisioned.

Four subsequent coverings A, B, C, D of the surface of the rotational functional component are shown in FIG. 2. Two-sided printed sheets 22, 24 are displayed as sheets provided with a crossed-line pattern. One-sided printed sheets 21 are displayed as sheets provided with a single-line pattern. The one-sided printed sheets 21 have their printed side towards the surface of the rotational functional component according to the invention. Both sheets indicated by reference FIG. 21 correspond to the same one-sided printed sheet. Both sheets indicated by reference FIG. 24 correspond to the same two-sided printed sheet.

An arbitrarily selected location 27 on the surface of the rotational functional component is shown as black spots 27. The inter sheet distance 25 is determined in such a way that two-sided printed sheets do not cover the location 27 in subsequent revolutions of the rotational functional component. In the first covering A a two-sided printed sheet covers location 27. In the second covering B a one-sided printed sheet covers location 27. In the third covering C a two-sided printed sheet covers location 27. In the fourth covering D no sheet covers location 27. In a next covering (not shown) the location 27 will be covered by a one sided printed sheet.

FIG. 2 is an example of 0% overlap of each location on the rotational functional component in subsequent revolutions of the rotational functional component.

A location covered by a one-sided printed sheet in a covering A, B, C is abutted on to a location covered by a one-sided printed sheet in a next covering B, C, D respectively as indicated by the dashed lines 28. In this way each location on the surface is cleaned. On the other hand, since one-sided printed sheets and two-sided printed sheets are alternately covering the surface, each location is also going to be polluted.

Experiments executed by the inventors have revealed that, depending on the combination of a media type of the used sheets and the used type of marking material, it may be allowed to have more than one two-sided printed sheet covering the same location on the surface of the rotational functional component before cleaning is necessary by a one-sided printed sheet on that location.

Figure 3:
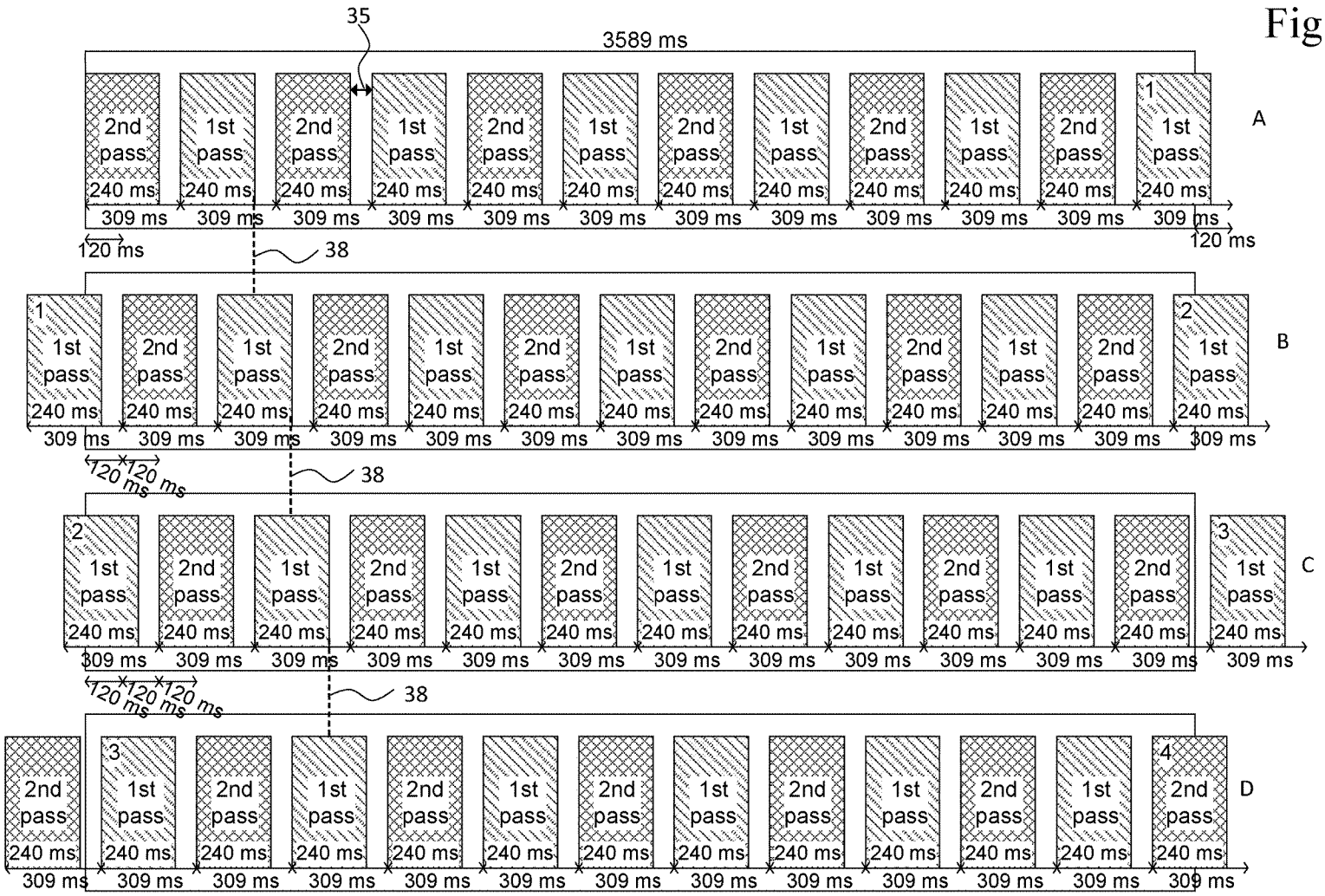
FIG. 3 is a second schematic view of scheduled sheets on the surface of the rotational functional component of the printing system according to the invention.

FIG. 3 is a second schematic view of scheduled sheets on the surface of the rotational functional component of the printing system according to the invention, wherein an overlap of 50% is achieved. An inter sheet distance 35 is now decreased to a corresponding time interval of 69 msec. Two two-sided printed sheets are scheduled on the same location on the surface of the rotational functional component in subsequent coverings of the rotational functional component before a one-sided printed sheet prevents the built up of pollution by marking material, i.e. an overlap of coverings on one location of 50% is allowed.

A location covered by a one-sided printed sheet in a covering A, B, C is 50% overlapping with a location covered by a one-sided printed sheet in a next covering B, C, D respectively as indicated by the dashed lines 38. In this way each location on the surface is cleaned once in a number of more than two coverings of the location. On the other hand, since one-sided printed sheets and two-sided printed sheets are alternately covering the surface, each location is also going to be polluted. Other degrees of partially overlap may be envisioned based on the degree of pollution for a particular media/ink combination.

Figure 4:
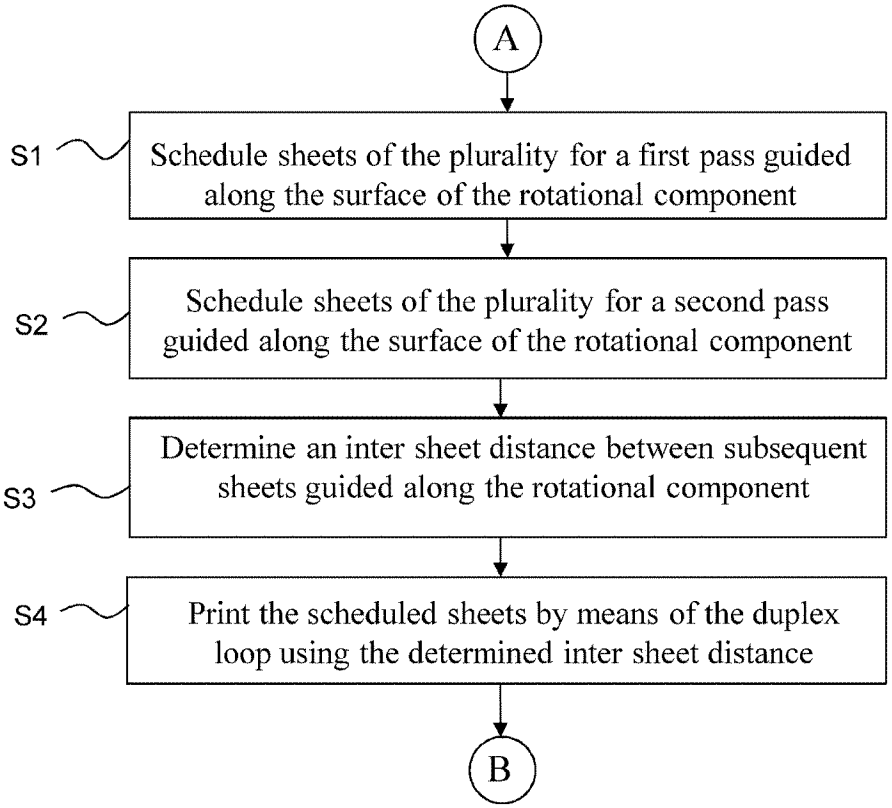
FIG. 4 is a flow diagram of an embodiment of the method according to the invention.

FIG. 4 shows a flow diagram of an embodiment of the method according to the invention. The method is suitable for time scheduling a plurality of sheets in a duplex printing loop of a printing system which comprises a control unit for controlling the printing of image data on the plurality of sheets and scheduling the plurality of sheets in a printing order. A paper path comprises the duplex printing loop in order to enable printing on both sides of the plurality of sheets in an interweaving first and second pass in the duplex printing loop. The printing system comprises a print head or print assembly arranged in the duplex printing loop for disposing marking material on the sheets according to the image data and a rotational functional component arranged in the duplex printing loop for guiding and processing printed sheets along or on a surface of the rotational functional component.

The method starts in starting point A and leads to a first step S1.

In the first step S1 sheets of the plurality are scheduled for a first pass guided along or on the surface of the rotational functional component.

In a second step S2 sheets of the plurality are scheduled for a second pass guided along or on the surface of the rotational functional component.

The first step S1 and the second step S2 may be combined in order to schedule the first and second pass of a sheet before scheduling the first and second pass of the next sheet. The control unit of the printing system according to the invention comprises a sheet scheduling section for determining the convenient schedule. In order to achieve a high productivity sheets for the first pass and sheets for the second pass may be alternately scheduled on the surface of the rotational functional component.

In an optional step between the second step S2 and a third step S3 a degree of pollution for the used marking material and the used media type is retrieved from the control unit of the printing system according to the invention.

In a third step S3 an inter sheet distance between subsequent sheets guided along or on the surface of the rotational functional component is determined such that each location on the surface of the rotational functional component is covered by printed sides of two-sided sheets at most a maximum number of times before the location on the surface of the rotational functional component is covered by an unprinted side of a sheet. The maximum number of times is determined by a degree of pollution caused by the marking material printed on two-sided printed sheets when taking a second pass along or on the surface of the rotational functional component. Preferably the maximum number of times is determined dependently on the media type used and/or the marking material used. The inter sheet distance may be retrieved from a look up table in the controller with entries like marking material, media type, degree of pollution, inter sheet distance. Such a retrieval may take place in combination with the optional step mentioned here-above.

In a fourth step S4 the scheduled sheets of the plurality are printed by means of the duplex printing loop using the distance determined in the third step S3.

The method ends in an end point B.

The described embodiments of the printing system according to the invention may be varied upon and/or combined according to skills of a skilled person in the art.

The described embodiments of the method according to the invention may be varied upon and/or combined according to the skills of a skilled person in the art.

The skilled person will recognise that other embodiments are possible within the scope of the appended claims.

The invention claimed is:

1. A printing system for cut sheets, the printing system comprising:

a controller configured to control the printing of image data on a plurality of sheets and scheduling the plurality of sheets in a printing order;

a paper path comprising a duplex printing loop and a rotational functional component arranged in the duplex printing loop for guiding and processing a printed sheet for two passes along or on a surface of the rotational functional component; and a print engine arranged in the duplex printing loop and configured to dispose marking material on the sheets according to the image data, in two passes, one side per pass, wherein the controller is configured to schedule one-sided printed sheets for a first pass guided along or on the surface of the rotational functional component and two-sided printed sheets for a second pass guided along or on the surface of the rotational functional component by using the duplex printing loop and to determine a distance between subsequent sheets guided along or on the surface of the rotational functional component such that a location on the surface of the rotational functional component is covered by printed sides of two-sided printed sheets at most a maximum number of times before the location on the surface of the rotational functional component is covered by an unprinted side of a one-sided printed sheet.

2. The printing system according to claim 1, wherein the controller is configured to schedule alternately sheets for the first pass and sheets for the second pass guided along or on the surface of the rotational functional component.

3. The printing system according to claim 1, wherein the maximum number of times is corresponding to a number of revolutions of the rotational functional component.

4. The printing system according to claim 3, wherein the number of revolutions of the rotational functional component is equal to a natural number n greater or equal to two, leading to a location on the rotational functional component being covered by an unprinted sheet each n-th revolution of the rotational functional component.

5. The printing system according to claim 1, wherein pollution is caused by the marking material printed on two-sided printed sheets when taking a second pass along or on the surface of the rotational functional component.

6. The printing system according to claim 1, wherein the rotational functional component is a fixation drum or fixation belt for fixing the marking material to the sheets.

7. The printing system according to claim 6, wherein the marking material is a toner substance and the rotational functional component is a fuser for fusing the toner substance on the sheets.

8. The printing system according to claim 6, wherein the marking material is an ink substance and the rotational functional component is a drying device for drying the ink substance on the sheets.

9. The, printing system according to claim 1, wherein the maximum number of times is determined per media type of the sheets to be printed and/or per type of marking material to be used for printing on the sheets.

10. A method for time scheduling a plurality of sheets in a duplex printing loop of a printing system, the printing system comprising a controller configured to control the printing of image data on the plurality of sheets and scheduling the plurality of sheets in a printing order, a paper path comprising the duplex printing loop in order to enable printing on both sides of the plurality of sheets in an interweaving first and second pass in the duplex printing loop, a print head or print assembly arranged in the duplex printing loop for disposing marking material on the sheets according to the image data, and a rotational functional component arranged in the duplex printing loop for guiding and processing printed sheets along or on a surface of the rotational functional component, wherein the method comprises the steps of:

scheduling sheets of the plurality of sheets for a first pass guided along or on the surface of the rotational functional component;

scheduling sheets of the plurality of sheets for a second pass guided along or on the surface of the rotational functional component;

determining a distance between subsequent sheets guided along or on the surface of the rotational functional component such that each location on the surface of the rotational functional component is covered by printed sides of two-sided sheets at most a maximum number of times before the location on the surface of the rotational functional component is covered by an unprinted side of a sheet, the maximum number of times being determined by a degree of pollution caused by the marking material printed on two-sided printed sheets when taking a second pass along or on the surface of the rotational functional component; and printing the scheduled sheets of the plurality by means of the duplex printing loop using the determined distance.

11. The method according to claim 10, wherein the method comprises the step of scheduling alternately sheets for the first pass and sheets for the second pass guided along or on the surface of the rotational functional component.

12. The method according to claim 10, wherein the maximum number of times is corresponding to a predetermined number of revolutions of the rotational functional component taking into account the degree of pollution.

13. The method according to claim 10, wherein the method comprises the step of abutting a location covered by a one-sided printed sheet in a covering of the surface of the rotational functional component on to a location covered by a one-sided printed sheet in a next covering of the surface of the rotational functional component.

14. The method according to claim 10, wherein the method comprises the step of partially overlapping a location covered by a one-sided printed sheet in a covering of the surface of the rotational functional component with a location covered by a one-sided printed sheet in a next covering of the surface of the rotational functional component, wherein the degree of partially overlapping depends on the degree of pollution.

15. The method according to claim 10, wherein the maximum number of times is determined per media type of the sheets to be printed and/or per type of marking material to be used for printing on the sheets.

16. A software product comprising program code on a non-transitory computer-readable medium, wherein said program code, when loaded into a computer, causes the computer to act according to the method of claim 10.

* * * * *